United States Patent [19]

Bainbridge et al.

[11] 4,002,502

[45] Jan. 11, 1977

[54] ALUMINUM BASE ALLOYS

[75] Inventors: Ian Frank Bainbridge, Lower Templestowe, Australia; Colin McLean Adam, Pakuranga, New Zealand

[73] Assignees: Comalco Aluminium (Bell Bay) Limited, Tasmania; The University of Queensland, Queensland, both of Australia

[22] Filed: Aug. 6, 1974

[21] Appl. No.: 495,286

Related U.S. Application Data

[63] Continuation-in-part of Ser. No. 277,511, Aug. 3, 1972, abandoned.

[30] Foreign Application Priority Data

Aug. 9, 1971 Australia ..... 5827/71

[52] U.S. Cl. ..... 148/3; 75/138; 75/139; 75/142; 75/143; 75/147; 75/148; 148/32

[51] Int. Cl.[2] ..... C22F 1/04

[58] Field of Search ..... 75/138, 139, 142, 143, 75/147, 148; 148/32, 32.5, 3, 13

[56] References Cited

UNITED STATES PATENTS 3,827,917 8/1974 Zeigler et al. ..... 75/138

*Primary Examiner*—R. Dean
*Attorney, Agent, or Firm*—Pollock, Vande Sande & Priddy

[57] ABSTRACT

Aluminum base alloys, having improved properties as regards mechanical working treatments, according to the invention are characterized by a content of 0.5 – 10.0 wt. % iron, without or with a very small content (up to 0.1 wt. %) of Li or Na or Sr or Ba. The alloy has a microstructure comprising a substantial portion of refined $Al_3Fe$ and/or very fine $Al_6Fe$.

6 Claims, 9 Drawing Figures x100 x 250

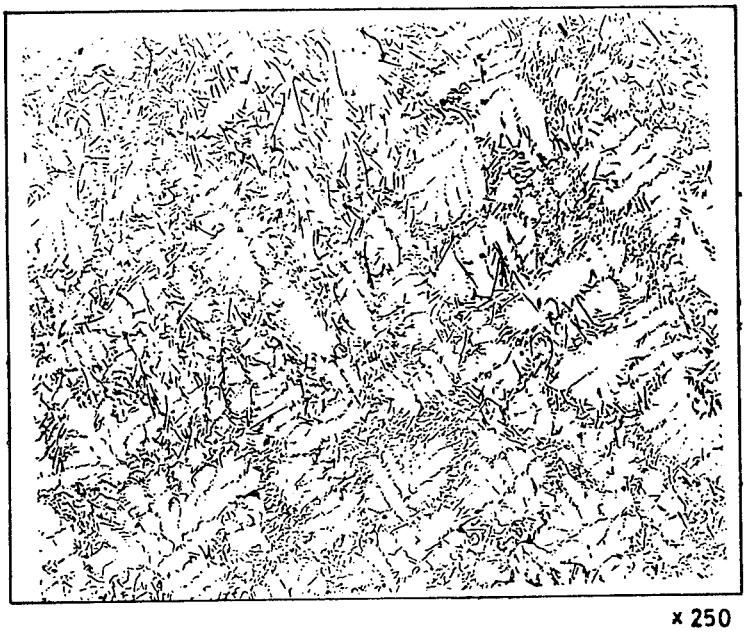
x 250
FIG. 6.
FIG. 7.
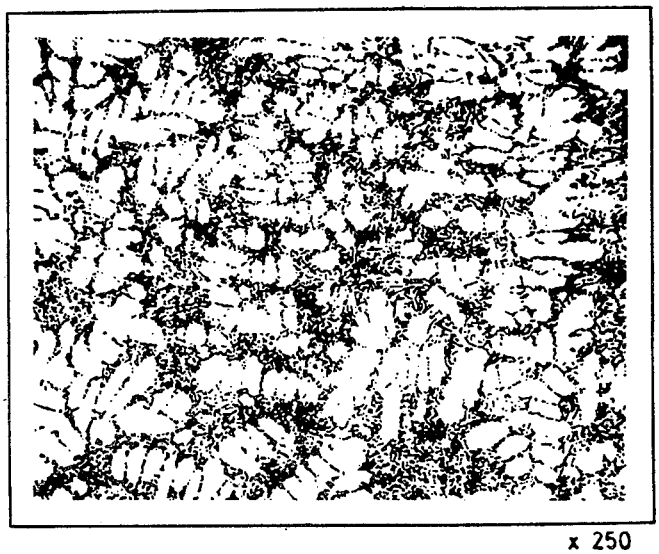
x 250 x 500

ALUMINUM BASE ALLOYS

This is a continuation-in-part of our prior copending application Ser. No. 277,511, filed Aug. 3, 1972, which is now abandoned.

This invention relates to aluminium base alloys, and one object is to provide aluminium-iron alloys possessing greatly improved properties over conventional alloys designed for mechanical working treatments.

Reference is made in the following description to the accompanying drawings FIGS. 1 to 8 wherein FIG. 1 shows an Al-Fe equilibrium phase diagram FIG. 2 illustrates the microstructure of an Al-3% Fe alloy showing the normal coarse $Al_3Fe$ needle shaped compounds present in the structure.

FIG. 3(a) illustrates the microstructure of an Al-3% Fe alloy showing the refined form of the $Al_6Fe$ compound.

FIG. 6 illustrates the microstructure of an Al-3% Fe alloy containing sodium showing the refinement of the structure achieved.

FIG. 7 illustrates the microstructure of an Al-3% Fe alloy containing strontium showing the refinement of the structure achieved.

Figure 1:
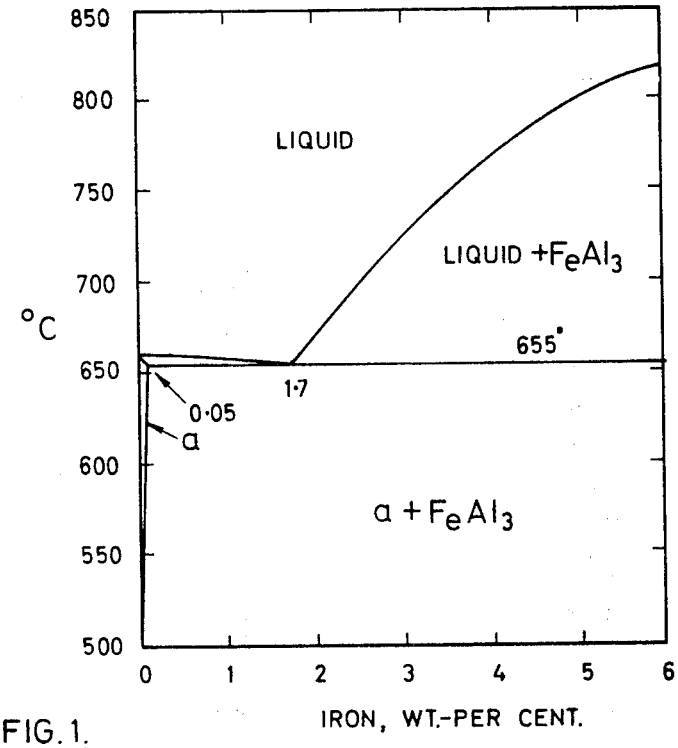
Figure 2:
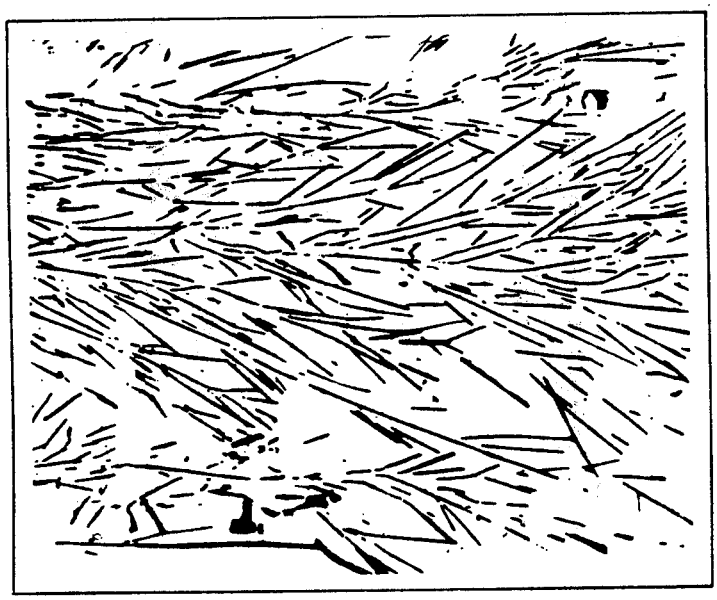

The aluminium-iron alloys as a class have not been developed commercially to any extent primarily due to the embrittling nature of the aluminium-iron compound formed in the alloy structure on solidification. FIG. 1 shows that the aluminium rich aluminium-iron alloys form a simple eutectic phase system similar to that of the aluminium-silicon alloys. Iron has only slight solid solubility in aluminium and forms a compound $Al_3Fe$ which undergoes a eutectic reaction at 1.7% Fe and 655° C. The microstructure normally present in aluminium-iron alloys at the slow and moderate rates of solidification encountered in practice, is one containing large particles or long interconnected plates of the $Al_3Fe$ compound. (See FIG. 2). The $Al_3Fe$ compound being hard and brittle, renders any alloys having such structures of low commercial value due to their inherently low ductility. Further, the large particles offer little dispersion hardening effect and the tensile strength of the alloys is only marginally above that of pure aluminium. The mechanical working of the alloys by rolling, forging, extrusion, etc. is impractical owing to the coarse nature of the aluminium - $Al_3Fe$ eutectic.

For the above reasons the aluminium-iron based alloys have not been commercially developed, and indeed it has hitherto been a general aim for most commercial aluminium alloys to have iron contents as low as possible.

It is one object of the invention to so refine the structures formed in aluminium rich aluminium-iron alloys as to render them suitable for commercial use in both cast and wrought forms. Refinement of the alloy structures greatly improves the mechanical properties, particularly the ductility, and enables the alloys to be subsequently shaped by conventional metal working processes. It is a further object of the invention to provide controlled and stable refinement of the structures formed on solidification of the alloys.

Figure 3:
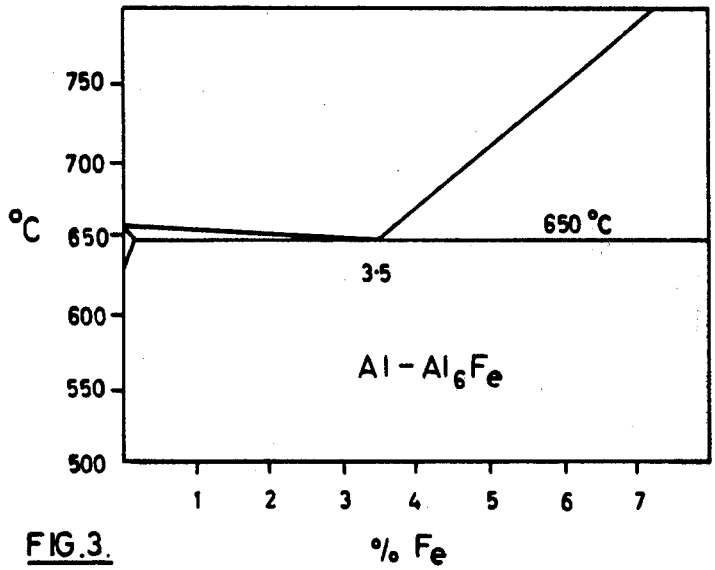
FIG. 3 is a proposed phase diagram showing the formation of the Al-$Al_6Fe$ eutectic.
Figure 3:
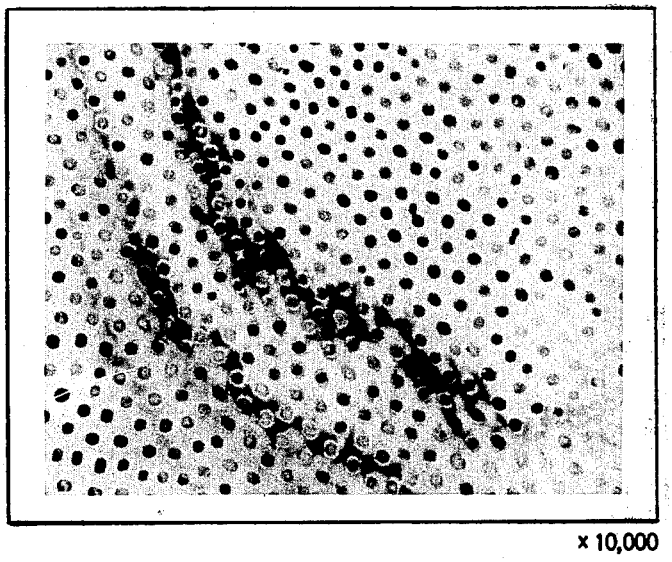

As well as the equilibrium phase, $Al_3Fe$, formed in aluminium rich aluminium-iron alloys on solidification, an additional compound $Al_6Fe$ is formed under particular conditions of solidification and/or when specific alloy additions are made. This compound forms by a eutectic type reaction with aluminium at a eutectic composition of approximately 3.5% Fe, and at a eutectic temperature lower than the aluminium - $Al_3Fe$ eutectic temperature. FIG. 3 shows a proposed phase diagram for the formation of the Al-$Al_6Fe$ eutectic. This proposed phase diagram is based on results obtained in the course of the development of the alloys of this invention. The structure formed is very fine, the $Al_6Fe$ compound taking the form of short interconnected rods which appear cylindrical in section (see FIG. 3(a)), and the Al-$Al_6$ Fe eutectic constitutes 90% or more of the microstructure.

The compound $Al_3Fe$ can also be made to assume comparable structures under particular conditions of solidification in combination with special alloy additions. It is hence a further object of the invention to define the particular conditions of solidification and/or the alloy additions necessary to cause either the formation of the $Al_6Fe$ compound or the refinement of the $Al_3Fe$ compound, whereby to attain, in the microstructure at least 90% content of Al-$Al_3Fe$ eutectic in refined form, i.e. $Al_3Fe$ having a particle size not greater than 10 microns. By the expression "refined form" as used herein, with special reference to a form of $Al_3Fe$, we mean having a particle size not greater than 10 microns.

We have found that the parameters needing to be varied to control the form of the two compounds are:

a. the temperature gradient existing between the solid and liquid metal during casting, commonly referred to as G, expressed in degrees C/millimeter;

b. the growth rate of the alloy phases as they solidify, commonly referred to as R, expressed in microns/-second; and c. the composition of the alloy, particularly with respect to trace alloying element additions.

Control of the temperature gradient G may be achieved by careful control of the temperature of the molten metal, the rate of pouring, the rate of cooling and the progress of solidification. One way in which such control can be effected is by use of a directional solidification furnace. As is well known, a furnace of this type is designed so that there is relative movement between a column of metal and the furnace cavity. Other important means for such control include the operation of a direct chill (D.C.) casting station in such a way as to produce the required temperature gradient. The value G is, in the present context, greater than 1° C./millimeter and may amount to several degrees C per millimeter.

Figure 4:
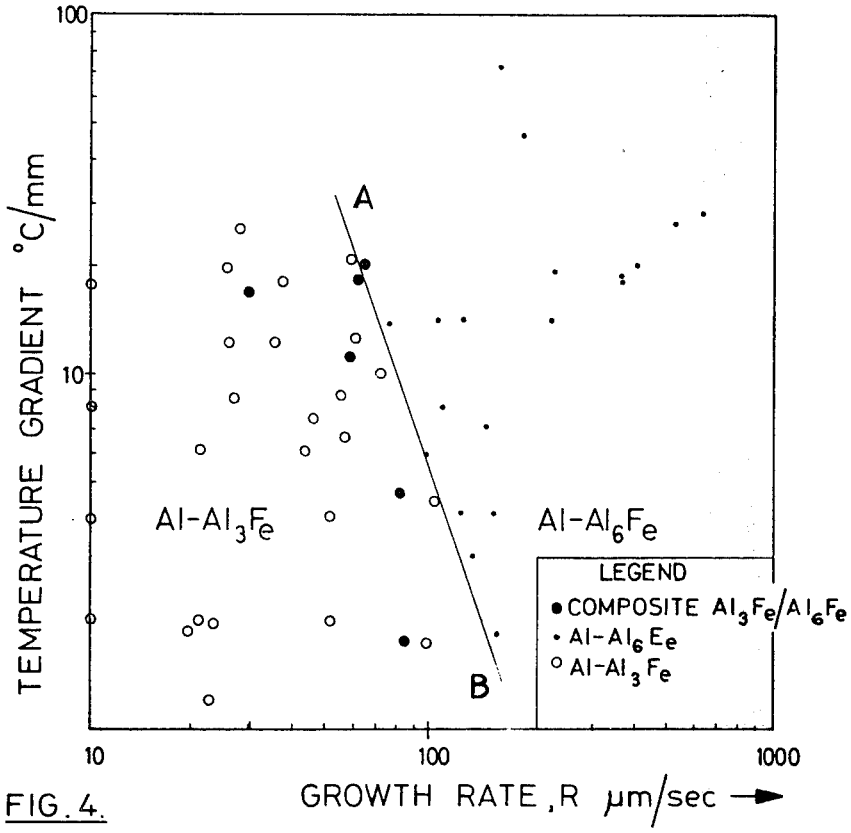
FIG. 4 shows the influence of temperature gradient G and growth rate R on the formation of the two types of eutectic structure in aluminium-iron alloys.

The growth rate R also varies with the rate of heat extraction from the solidifying metal, a high rate of heat extraction yielding a high growth rate. For the formation of $Al_3Fe$ the growth rate (R) is within the range 1–500 microns per second, whilst the growth rate for formation of $Al_6Fe$ is at least 100 microns/second and preferably is greatly in excess of the latter value. The effect of the growth rate and temperature gradient on the formation of the two different compounds $Al_3Fe$ and $Al_6Fe$ can best be expressed and controlled by a diagram such as that shown in FIG. 4. A preferred structure containing the compound $Al_6Fe$ in binary alloys containing only aluminum and iron is obtained by exceeding the growth rate/temperature gradient parameters defined by the boundary line A—B in the diagram. In practice it has been found that the usual alloy impurities present in aluminum do not markedly influence the position of the transition boundary between the two types of structures. As the Al-$Al_6Fe$ eutectic structure has a characteristic form that results in markedly improved mechanical properties of the alloy, due to the refined or modified nature of the structure, it is a preferred feature of the invention to produce such a structure by selection of casting conditions to achieve the temperature gradient and growth rate necessary for formation of the $Al_6Fe$ compound as defined by the area to the right of the boundary line A—B in the diagram in FIG. 4. However, in practical situations either in the production of castings by conventional processes, or when casting shapes for subsequent mechanical working by the semi-continuous process, it may not always be possible to achieve the growth rate/temperature gradients required for the formation of the $Al_6Fe$ structure throughout the complete cross-section. Another important preferred aspect of the invention, therefore, is the addition of alloying elements in trace quantities (0.005 – 0.10%) to achieve:

a. a refinement of the $Al_3Fe$ structure and/or b. an effective displacement of the boundary delineating the two structures to conditions of lower temperature gradients and lower growth rates (i.e. effective movement of the boundary to the left and downwards in FIG. 4) thereby enabling the formation of the desired $Al_6Fe$ structure under conditions encountered in practical casting situations.

Thus, a refined structure containing the $Al_6Fe$ compound or a refinement (i.e., to a particle size less than 10 microns) of the $Al_3Fe$ compound can be produced by addition to the alloy of one or more of the elements, lithium, sodium, strontium, barium, in individual amounts of 0.005 to 0.10%, the total addition not exceeding 0.4%, in conjunction with solidification under the appropriate temperature gradient and growth rate conditions.

Figure 5:
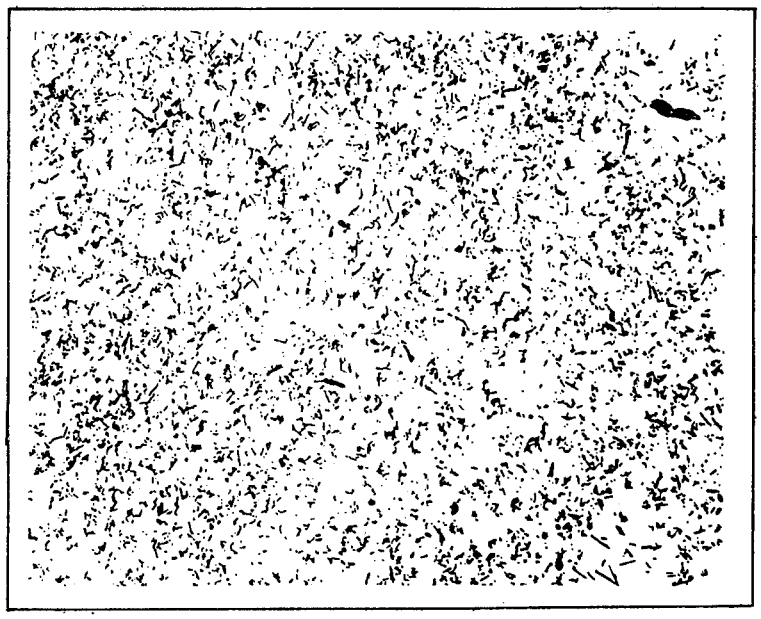
FIG. 5 illustrates the microstructure of an Al-3% Fe alloy containing lithium showing the refinement of the structure achieved.

The effect of each alloying element enumerated above is dependent upon the combination of conditions of temperature gradient, growth rate and percentage addition. For example it is found that at very low temperature gradients and growth rates, it is possible to refine the $Al_3Fe$ compound by the addition to the alloy of e.g. 0.12% lithium (see FIG. 5) or 0.05% sodium (see FIG. 6), whereas strontium additions to 0.05% have no effect until the temperature gradient is increased to greater than 30 degrees C/millimeter, when the $Al_6Fe$ structure can be formed (see FIG. 7).

The invention accordingly provides aluminum base alloys containing 0.5% to 10% Fe and the usual impurities, which may include Mg, Mn, Si, Cu, Ti, up to a total maximum of 0.5%. In a preferred form the alloys may also contain one or more elements selected from the group consisting of lithium, sodium, strontium and barium in the range 0.005 to .10% of each, the total addition not to exceed 0.4.

The invention also provides a heat-treatment of the alloy so as to produce a ductile structure suitable for ease of mechanical working treatments.

The abovementioned alloying elements may be added to the molten alloy either prior to, or subsequent to the addition of iron to the molten aluminium, and may be added either as the element or in the form of a hardener, or reacted with molten aluminium as a flux to achieve the addition by chemical reaction.

Figure 8:
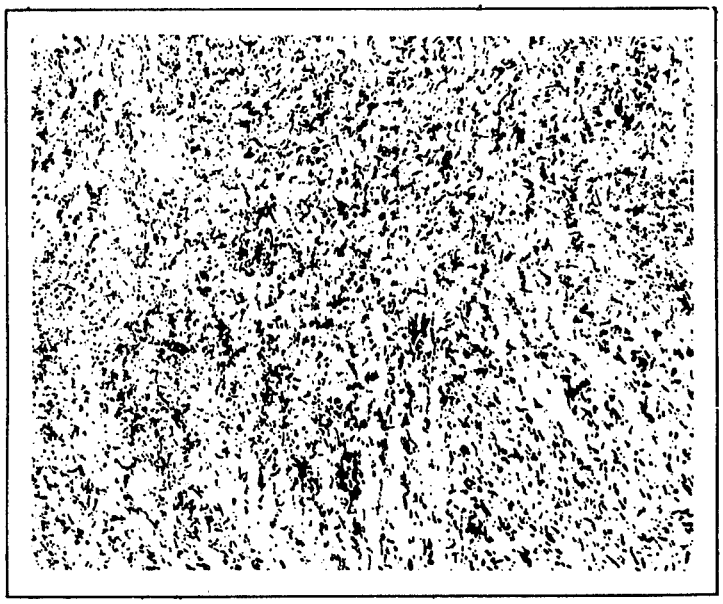
FIG. 8 shows fully refined $Al_6Fe$ structure produced by rapid cooling of the alloy and subsequent cold working.

By way of actual example the mechanical properties in the (i) as cast and (ii) cold worked condition of a typical aluminium-iron alloy (2.5% Fe) possessing the Al-$Al_6Fe$ structure are shown in Table 1. The actual structure of the alloy is shown in FIG. 8. This alloy did not contain any of the above-specified alloying elements.

TABLE 1

| Condition | 0.1% Proof Stress (lbs/sq.in) | U.T.S. (Ultimate) Tensile Strength (lbs/sq.in) | % Elongation |
|---|---|---|---|
| | 48,510 | 62,515 | 2.7 |
| As cast | 36,414 | 77,285 | 0.4 |
| (growth rate | 32,720 | 63,150 | 2.6 |
| R = 2500 | 55,510 | 78,175 | 0.4 |
| microns/sec, | 44,050 | 64,680 | 2.1 |
| temperature G = 10° C/mm | | | |
| Above cold | 48,510 | 55,510 | 8 |
| worked | 43,930 | 56,022 | 7 |
| (94% Reduc- | 49,780 | 55,000 | 8 |
| tion of Area) | 51,660 | 56,150 | 7 |

It will be seen that as a result of possessing the Al-$Al_6Fe$ structure which was produced by controlling the growth rate R during casting and solidification, using a directional solidification furnace, excellent strength, stiffness and elongation values are obtained in the above alloy.

For a comparison a typical range of as cast mechanical properties of a similar alloy containing 2.5% Fe, but prepared in such a way that the values of R and G required to form the $Al_6Fe$ structure are not attained, are shown in Table 2. This alloy contains an unrefined $Al_3Fe$ structure, and is a brittle and much weaker alloy. It contains large particles or long interconnected plates of the $Al_3Fe$ compound, and cannot be cold worked satisfactorily (see also FIG. 2).

| 0.1% Proof Stress (lbs/sq.in) | U.T.S. (lbs/sq.in) | % Elongation |
|---|---|---|
| 9,600 – 15,000 | 15,000 – 30,000 | 1 – 3 |

It has been stated earlier in this specification that the addition of one or more of the elements Li, Na, Sr, Ba, in amounts ranging from 0.005 – 0.10% with the total not exceeding 0.4% (see also FIGS. 5, 6 and 7) enables refinement of the Al-Fe structures of aluminium-iron alloys and consequent improvements in mechanical properties, particularly in ductility. Typical results obtained are shown in Table 3 below:

TABLE 3

| Alloy | 0.2% Proof Stress (lbs/sq.in) | U.T.S. (lbs/sq.in) | % Elongation |
|---|---|---|---|
| Aluminium-2.8% Fe | 6,500 | 12,000 | 2.8 |
| Aluminium-2.8% Fe | 8,300 | 16,200 | 10.5 |

TABLE 3-continued

| Alloy | 0.2% Proof Stress (lbs/sq.in) | U.T.S. (lbs/sq.in) | % Elongation |
|---|---|---|---|
| 0.06% Sr | | | |

The growth rate R is both the above alloys was the same, 100 microns/minute.

Another advantage of the alloys of this invention possessing the preferred microstructures herein described, is that their ductility in the as cast condition can be very significantly improved by prolonged thermal treatments at temperatures just below the eutectic temperatures followed by air cooling or water quenching. This is clearly indicated in the results presented in Table 4.

TABLE 4

| Alloy | 0.2% Proof Stress (lbs/sq.in) | U.T.S. (lbs/sq.in) | % Elongation |
|---|---|---|---|
| (A) Aluminium-2.8% Fe, 0.06% Sr, as cast. | 8,300 | 16,200 | 10.5 |
| (A) after holding at 600° C for: | | | |
| 8 hours | 6,700 | 14,700 | 17 |
| 16 hours | 6,450 | 15,100 | 19 |
| 24 hours | 6,400 | 14,700 | 20 |
| (B) Aluminium-2.6% Fe, as cast,(6 7/16" diameter billet in direct chill mould). | Not Determined | 20,000–23,000 | 10–15 |
| (B) after holding at 600° C for 8 – 24 hours and air cooling | | 15,000–16,000 | 23–26 |
| (B) after holding at 600° C for 24 hours and cold water quenching. | | 15,300–15,600 | 21–25 |

Some typical hardness values of an alloy containing 2.6% Fe before and after exposure to 600° C, respectively, slowly cooled and quenched are given below:

TABLE 5

| Alloy | Typical Vickers Hardness No. (10 gram load) |
|---|---|
| Aluminium - 2.6% Fe, as cast in form of 6 7/16" diameter billet, with $Al_6Fe$ | 58 |
| As above, heated to 600° C for 8 to 24 hours, slow cool. | 46 |
| As above, heated to 600° C for 24 hours, cold water quench. | 30 |

The corrosion resistance of the alloys of this invention is roughly comparable with that of aluminium alloys in the 6000 series.

We claim:

1. In a method of casting aluminum-iron alloy from a melt with a controlled temperature gradient between the solid and liquid metal and with a controlled rate of growth of the alloy phases as they solidify, said alloy consisting essentially of aluminum and 0.5 to 10% by weight of iron and having a cast microstructure containing aluminum and eutectic compounds including $Al_3Fe$ and $Al_6Fe$ and mixtures thereof, the improvement which comprises providing in said melt at least one constituent from the group consisting of lithium, sodium, strontium or barium in an amount which is effective to improve the strength or ductility of said alloy by producing in said alloy a refined form of $Al_3Fe$ or very fine $Al_6Fe$, the amount of each constituent being up to 0.1% by weight of said melt and the total amount of such constituents not exceeding 0.4% by weight of said melt.

2. Method according to claim 1 wherein the temperature gradient and growth rate during casting are controlled at values to the right of boundary line A–B of FIG. 4 hereof.

3. Method according to claim 1 wherein the resultant alloy is subjected to prolonged thermal treatment just below the eutectic temperature for more than 8 hours, followed by air cooling or water quenching, whereby improved ductility is obtained.

4. The cast product produced by the method of claim 1.

5. The cast product produced by the method of claim 2.

6. The cast product produced by the method of claim 3.

* * * * *